United States Patent [19]

De Vrijer

[11] 4,319,157

[45] Mar. 9, 1982

[54] HIGH PRESSURE MERCURY VAPOR DISCHARGE LAMP

[75] Inventor: Bertus De Vrijer, Eindhoven, Netherlands

[73] Assignee: U.S. Philips Corporation, New York, N.Y.

[21] Appl. No.: 113,844

[22] Filed: Jan. 21, 1980

[30] Foreign Application Priority Data

Feb. 26, 1979 [NL] Netherlands ..... 7901480

[51] Int. Cl.[3] ..... H01J 61/20

[52] U.S. Cl. ..... 313/225; 313/229

[58] Field of Search ..... 313/229, 225

[56] References Cited

U.S. PATENT DOCUMENTS

| | | | |
|---|---|---|---|
| 3,279,877 | 10/1966 | Smith et al. | 313/229 X |
| 3,958,145 | 5/1976 | Jack et al. | 313/229 X |
| 4,001,626 | 1/1977 | Drop et al. | 313/229 |
| 4,027,190 | 5/1977 | Shintani et al. | 313/229 |

FOREIGN PATENT DOCUMENTS

| | | |
|---|---|---|
| 2195063 | 3/1974 | France . |

*Primary Examiner*—Palmer C. Demeo

*Attorney, Agent, or Firm*—Robert S. Smith

[57] ABSTRACT

A high-pressure mercury vapor discharge lamp comprising tin iodide, tin chloride and tin bromide in addition to a rare gas and mercury. The molar fraction of iodine is at least 0.20, the molar fraction of bromine at least 0.25 and the molar fraction of chlorine at least 0.05.

1 Claim, 2 Drawing Figures

HIGH PRESSURE MERCURY VAPOR DISCHARGE LAMP

Figure 1:
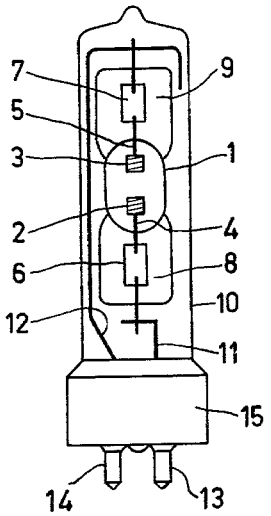

The invention relates to a high-pressure mercury vapor discharge lamp having a discharge vessel closed in a vacuum-tight manner, provided with electrodes and contains a rare gas, mercury and a tin halide.

Such a lamp is disclosed in German Patent Application 2,023,770. These lamps, which contain tin chloride and tin iodide predominantly produce radiation originating from tin halide molecules. The tin halide radiation has a very wide, continuous spectral distribution, so that the color rendering of these lamps can be very good. Generally, values of the color rendering index Ra (the average of the color rendering indices of 8 test colors, as defined by the Commission Internationaled-'Eclairage) of approximately 85 can be obtained. It appeared that in the radiation emitted by these lamps, the proportion of continuum radiation originating from the tin halide molecules increases as the total tin halide concentration in the lamp increases. This continuum increase, with increasing tin halide concentration promotes the color rendering obtainable with the lamp. However, it appeared in practice that the halide concentration cannot exceed certain upper limits. On the one hand the iodine concentration must not be too high because an excessive absorption of blue radiation occurs above a certain value, causing the color temperature of the radiation emitted by the lamp to decrease too much and the luminous efficacy to decrease. On the other hand, the chlorine concentration must not be too high because an excessive corrosion of the electrodes would then occur, which would have a detrimental effect on the life of the lamp. Although in certain cases a value of 4 is permissible for the molar ratio of the chlorine to the iodine, this ratio is usually approximately 1 in order to achieve a satisfactory life of the lamp. A further drawback of tin chloride-containing lamps is that they not only show the tin halide continuum, but also the emission of the mercury chloride band in the green portion of the spectrum with a maximum approximately 540 nm, so that the light emitted by the lamp has a green aspect (the color point of the emitted radiation deviates from the line of the radiant black bodies).

Tin halide-containing high-pressure mercury vapor discharge lamps are also disclosed in Netherlands Patent Application 6610396. These lamps contain tin bromide and tin iodide and also produce a tin halide radiation having a continuous spectral distribution. The luminous efficacy of these lamps is, however, considerably lower (for example 20 to 25% lower) than that of the lamps containing tin chloride and tin iodide.

It is an object of the invention to provide tin halide-containing lamps which furnish in combination a high luminous flux, a very good color rendition and an increased proportion of continuum radiation, and in which the drawbacks of high chlorine and iodine concentrations are avoided.

According to the invention, a high pressure mercury vapor discharge lamp of the type described in the preamble is characterized in that the discharge vessel contains tin iodine, tin chloride and tin bromide, the molar fractions of iodine, bromine and chlorine present in the discharge vessel expressed in terms of total iodine, bromine and chlorine being at least 0.20, at least 0.25 and at least 0.05 respectively.

It appeared that the addition of tin bromide to a lamp which contains tin chloride and tin iodide increases the continuum radiation and results in an improvement in the color rendering. It appeared that the radiation efficiency of the lamps has substantially the same advantageous value as of the lamps which only contain tin chloride and tin iodide. This was totally unexpected, as the known bromide-containing lamps had a low efficiency. In addition, it appeared that the addition of bromine does not result in a disadvantageous absorption of blue radiation, which appeared to be the case when the iodine concentration was increased. It also appeared that the life of the lamp is not detrimentally affected by the bromine addition, as was the case when the chlorine concentration was increased. The lamps according to the invention have the added advantage that the transmitted radiation does not have a green color aspect. Namely, the green mercury chloride band is present to a lesser extent and the spectrum is further filled up by the mercury bromide band, which is mainly found in the blue portion of the spectrum (maximum at approximately 500 nm). Finally, it is a great advantage that in lamps according to the invention the total halide concentration can be higher than for lamps containing chloride and iodide only, as bromine is less corrosive than chlorine.

To obtain the above-mentioned advantageous effect it is necessary for the halogen concentrations to be within the above-defined limits. The molar fraction of bromine must be at least 0.25 of the total quantity of halogen present in the lamp. If this molar fraction is below 0.25, the effect of the bromine admixture is too low, resulting in lamps having a poor color rendering and a green color aspect. The molar fraction of iodine in the lamp must be at least 0.20, because with lower iodine molar fractions the electrodes would be corroded to an excessive extent, so that the life of the lamps would be too short. Finally, the molar fraction of chlorine should be at least 0.05 in a lamp according to the invention so as to ensure sufficiently high luminous fluxes.

Preference is given to a lamp according to the invention wherein the molar fraction of bromine is from 0.25 to 0.55 and the molar fraction of chlorine is from 0.10 to 0.25. The best results as regards color rendering and luminous efficacy are obtained in these ranges. It appears possible when using molar fractions of bromine and chlorine in this combination of ranges to obtain lamps whose color point of the emitted radiation is substantially located at the line of the radiant black bodies.

An advantageous embodiment of a lamp according to the invention is characterized in that the discharge vessel contains from 0.5 to 50 mg of mercury, preferably from 3 to 35 mg, and from 1 to 50 micromole of halogen preferably from 5 to 25 micromole, per cubic centimeter of its internal volume and in that the molar ratio of halogen to tin is from 0.1 to 2.5. The above-specified quantities of mercury produce an efficient high-pressure mercury vapor discharge. When less than the above-mentioned minimum quantity of halogen is used, the contribution of continuous tin halide radiation is generally too low. The use of a quantity of halogen exceeding the above-mentioned maximum quantity may result in lamps which burn in an unstable manner. The choice of the particular quantities of mercury and of halogen within the above-mentioned ranges which should be used in a given lamp depends on the lamp type. For wall-stabilized (long arc) discharge lamps, a relatively small quantity of mercury and halogen will generally be chosen; larger quantities are generally chosen for electrode-stabilized (short arc) discharge lamps or for magnetically stabilized discharge lamps. The halogen-tin ratio usually has such a value that an excess of tin is present. It is, however possible to use a small excess of halogen (relative to tin dihalide).

Furthermore, it may be desirable to perform in a lamp according to the invention a small correction of the color point of the emitted radiation in order to shift the color point to the line of the radiant black bodies. An embodiment of a lamp according to the invention is therefore characterized in that the discharge vessel also contains at least one of the elements Li, Na, In, Pb, Bi, Zn and Ga in a total quantity of 0.005 to 10 micromole cubic centimeter of the internal volume of the discharge vessel so as to correct the color point of the emitted radiation, the elements Li and Na being present as a chloride and the elements In, Pb, Bi, Zn and Ga being present as such or as a halide other than fluoride. The above-mentioned color point correction is known per se for tin halide-containing lamps. See Netherlands Patent Application 7303079 for the elements Li and Na and Netherlands Patent Application 7316101 for the remaining above-mentioned elements.

Some embodiments of the invention will now be described with reference to a drawing and a number of Examples.

In the drawing

Figure 2:
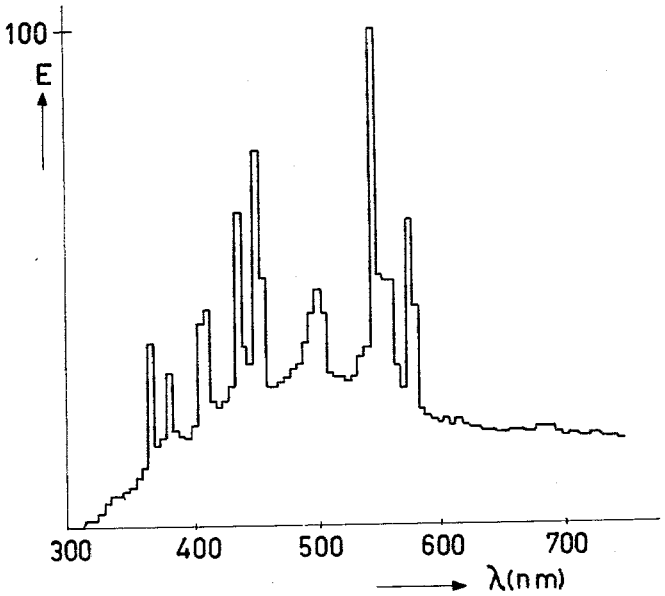

FIG. 1 shows a high-pressure mercury vapor discharge lamp according to the invention and FIG. 2 shows the spectral energy distribution of an embodiment of a lamp according to the invention.

Referring to FIG. 1, reference numeral 1 denotes a quartz glass discharge vessel of a lamp according to the invention. The discharge vessel 1 is provided with two oppositely arranged tungsten electrodes 2 and 3, respectively. The electrodes are supported by leads 4 and 5, respectively, which are fed through pinches 8 and 9, respectively, by means of molybdenum foils 6 and 7, respectively. The discharge vessel 1 is disposed in a quartz glass outer bulb 10 by means of support terminals 11 and 12, respectively, which also serve as current supply elements for the electrodes 2 and 3, respectively. The current supply elements 11 and 12, respectively, are led out through the outer bulb 10 in a vacuum-tight manner and are connected to contact pins 13 and 14, respectively, of a ceramic lamp base 15. The outside diameter of the outer bulb 10 is approximately 23 mm. The internal volume of the discharge vessel 1 is approximately 0.75 $cm^3$. The distance between the electrodes 2 and 3 is 5 mm. The lamp is intended for a load of 250 W.

EXAMPLE 1

The discharge vessel of a lamp, shown in FIG. 1, was filled with a pressure of approximately 4000 Pa (at room temperature) of a mixture of argon and krypton and in addition with 25 mg Hg 21 micromole Sn 0.7 micromole In 3.0 micromole Hg $J_2$ 2.0 micromole $HgBr_2$ 1.0 micromole $HgCl_2$. The molar fractions J, Br and Cl of the total halogen in the discharge vessel were 0.50, 0.33 and 0.17, respectively, and at a load of 250 W, the lamp had the following properties:

| | | |
|---|---|---|
| luminous flux | $\eta$ = 62 lm/W | |
| color temperature | T = 5500 K | |
| color rendering index | Ra = 85 | |
| color point | x = 0.330; | y = 0.360. |

The spectral energy distribution of the radiation emitted by this lamp is shown in a graph in FIG. 2. In this graph, the wavelength $\lambda$ is plotted in nm on the horizontal axis and the radiant energy E per wavelength-interval of 5 nanometers is plotted in arbitrary units on the vertical axis.

EXAMPLES 2 to 6, inclusive

Five lamps, each having a construction as shown in FIG. 1, were provided with a lamp filling as described in Example 1, but with different molar fractions of J, Br and Cl, namely 0.33, 0.50 and 0.17 respectively. Furthermore, the total quantity of halogen introduced into these lamps as $HgJ_2$, $HgBr_2$ and $HgCl_2$ ($=\Sigma HgX_2$) was different. The following Table 1 summarizes the results of measurements made on these lamps. For each Example, Table states in the column $\Sigma HgX_2$ the total quantity of mercury halide present in the discharge vessel in micromole and in the column $\eta$ the luminous flux in lm/W, in the column T the color temperature in K and in the column (x; y) the color point.

TABLE 1

| Example | $\Sigma HgX_2$ | $\eta$ | T | (x;y) |
|---|---|---|---|---|
| 2 | 5,6 | 65 | 4300 | 0.370;0.360 |
| 3 | 7,5 | 61 | 4100 | 0.375;0.375 |
| 4 | 10,1 | 64 | 3700 | 0.400;0.395 |
| 5 | 10,9 | 64 | 3600 | 0.405;0.400 |
| 6 | 16,5 | 66 | 3100 | 0.435;0.430 |

EXAMPLES 7 to 11 inclusive

Another five lamps were made, each having a construction as shown in FIG. 1, and provided with a filling similar to that specified in Example 1, except that the molar fractions J, Br and Cl were 0.33, 0.33 and 0.33, respectively, and these lamps contained different quantities of halogen (introduced as $HgX_2$). Table 2 summarizes the result of measurements made on these lamps.

TABLE 2

| Example | $\Sigma HgX_x$ | $\eta$ | T | (x;y) |
|---|---|---|---|---|
| 7 | 1.9 | 64 | 9000 | 0.290;0.310 |
| 8 | 4.1 | 69 | 7000 | 0.300;0.340 |
| 9 | 4.9 | 72 | 7000 | 0.300;0.340 |
| 10 | 6 | 69 | 5500 | 0.330;0.360 |
| 11 | 7.1 | 68 | 5800 | 0.330;0.370 |

EXAMPLE 12

A lamp, having a similar construction to that of the lamp shown in FIG. 1, but of which the discharge vessel has an internal volume of 2.7 $cm^3$ and the electrode spacing is 6 mm, the lamp being suitable for a load of 500 W, was filled with a pressure of approximately 4000 Pa of a mixture of argon and krypton and in addition with 80 mg Hg 33.7 micromole Sn 6.5 micromole In 5.4 micromole $HgJ_2$
3.6 micromole $HgBr_2$
1.8 micromole $HgCl_2$.

The following values were measured at this lamp wherein the molar fractions J, Br and Cl of the total halogen in the discharge vessel were 0.50, 0.33 and 0.17, respectively, (at a load of 500 W):

$\eta = 63$ lm/W
T = 5500 K
Ra = 85
x = 0.330; y = 0.360.

What is claimed is:

1. A high-pressure mercury vapor discharge lamp having a discharge vessel which is closed in a vacuum-tight manner, is provided with electrodes and comprises a rare gas, mercury and a tin halide, characterized in that the discharge vessel contains tin iodide, tin chloride and tin bromide, the molar fractions of iodine, bromine and chlorine present in the discharge vessel expressed in terms of the total iodine, bromine and chlorine being at least 0.20, at least 0.25 and at least 0.05 respectively, the molar fraction of bromine being from 0.25 to 0.55 and the molar fraction of chlorine being from 0.10 to 0.25, said discharge vessel containing from 3 to 35 mg of mercury, and from 5 to 25 micromole of halogen per cubic centimeter of its internal volume, and the molar ration of halogen to tin is from 0.1 to 2.5, said discharge vessel also containing at least one of the elements Li, Na, In, Pb, Bi, Zn and Ga, in a total quantity of 0.005 to 10 micromole per cubic centimeter of its internal volume for color point correction of the emitted radiation, and when present the elements Li and Na being present as a chloride and the elements In, Pb, Bi, Zn and Ga as such or as a halide other than a fluoride.

* * * * *